US007086557B2

(12) United States Patent
Miller et al.

(10) Patent No.: US 7,086,557 B2
(45) Date of Patent: Aug. 8, 2006

(54) ANIMAL RESISTANT TRASH CONTAINER LID AND TRASH CONTAINER SYSTEM

(75) Inventors: Bradley D. Miller, Jenison, MI (US); Frederick A. Greca, Jr., Rockford, MI (US)

(73) Assignee: Gill Industries, Inc., Grand Rapids, MI (US)

( * ) Notice: Subject to any disclaimer, the term of this patent is extended or adjusted under 35 U.S.C. 154(b) by 0 days.

(21) Appl. No.: 10/667,527

(22) Filed: Sep. 22, 2003

(65) Prior Publication Data

US 2005/0061824 A1 Mar. 24, 2005

(51) Int. Cl.
*B65D 43/14* (2006.01)

(52) U.S. Cl. ..... 220/836; 220/908

(58) Field of Classification Search ..... 220/908, 220/262, 836, 659, 680, 623, 602; D34/1–11
See application file for complete search history.

(56) References Cited

U.S. PATENT DOCUMENTS

| | | | | | |
|---|---|---|---|---|---|
| 4,520,945 | A | * | 6/1985 | Hodge | 220/315 |
| 4,955,501 | A | * | 9/1990 | Hodge | 220/315 |
| 4,976,371 | A | | 12/1990 | Wise et al. | |
| 5,167,351 | A | * | 12/1992 | Prout et al. | 220/840 |
| D351,704 | S | * | 10/1994 | Breen | D34/11 |
| 5,385,258 | A | | 1/1995 | Sutherlin | |
| D355,741 | S | * | 2/1995 | Craft et al. | D34/5 |
| D362,325 | S | * | 9/1995 | Taylor | D34/11 |
| D381,164 | S | * | 7/1997 | Prout et al. | D34/19 |
| 5,899,468 | A | * | 5/1999 | Apps et al. | 280/47.26 |
| 6,230,920 | B1 | | 5/2001 | Porter | |

* cited by examiner

*Primary Examiner*—Lien M. Ngo
(74) *Attorney, Agent, or Firm*—Warner Norcross & Judd LLP

(57) ABSTRACT

An animal resistant trash container lid has several transverse ridges cross the top. Longitudinal ridges are on the front of the trash container lid. Within the trash container lid is a frame. Holes in the front of the trash container lid are disposed to receive locks. The locks fasten the lid to the trash container. The trash container lid also has a handle and hinges integral with the frame and extending through the outer wall of the lid.

4 Claims, 4 Drawing Sheets

ANIMAL RESISTANT TRASH CONTAINER LID AND TRASH CONTAINER SYSTEM

BACKGROUND OF THE INVENTION

This invention relates generally to trash containers, and more particularly to trash containers which are animal resistant.

More people are moving away from urban centers and into rural areas. People generate garbage, and the communities in these rural areas provide garbage pickup. Residents of the community place their garbage into containers and place the containers near the road each week. The precise time of the garbage pickup is unknown. Thus, the containers are placed near the road and are left unattended for some amount of time. Often, the containers are left unattended overnight.

Leaving garbage containers unattended overnight in a rural area presents a substantial problem due to animals. Many animals, such as possums, bears and raccoons, search for food by invading the garbage containers. When the animals enter the container to search for food, the container is often tipped over and its contents are often strewn about. An eyesore and health hazard is often created, requiring the resident or the garbage collector to clean up the area.

Once an animal learns that food can be obtained from the garbage containers, the animal will continue to attempt to raid the garbage containers, creating an ongoing nuisance to the resident and the community. Ridding the community of the animals conditioned to raid garbage containers causes even more problems. For example, the common way to stop a bear from continually raiding garbage containers is to kill the bear.

Previous animal resistant garbage containers have been unsatisfactory. Most are immobile, thus requiring the garbage container to be positioned near the road so that it may be emptied. However, few people wish their garbage container to be prominently and permanently featured near the front of their home.

Some mobile animal resistant garbage containers often require significant modifications to the trash can so that an animal resistant lid can be used. Due to the time and effort required to make these modifications, this type of mobile animal resistant garbage container is likewise problematic.

Still other mobile animal resistant garbage containers require that the trash have a generally cylindrical or conical shape, so that the mechanism for securing the lid to the trash can fits around the can. However, many trash cans in common use today are generally rectangular rather than cylindrical or conical.

Thus, an improved animal resistant garbage lid for generally rectangular trash cans which can be installed with little modification to the trash can is highly desirable.

SUMMARY OF THE INVENTION

A trash container lid covers the top of a trash container. The trash container lid has a generally flat top with a series of steps surrounding the top. A plurality of transverse ridges extend across the top. The transverse ridges provide support for the top.

The trash container also has a frame for supporting the trash container lid. The frame is located on the inside of the lid, and provides additional structure so that an animal cannot easily tear or rip the trash container lid.

The trash container lid has a lower riser of sufficient length to cover the trash container's lip.

The lower riser substantially covers the trash container lip and is arranged so that the lower riser fits snugly against the trash container lip. The lower riser could be arranged so that the gap between the lower riser and the trash container is less than ¼ inch. The trash container lid could include a hinge for attaching the trash container lid to the trash container.

The trash container lid also has a longitudinal ridge. The longitudinal ridge extends from a middle riser to the top. The longitudinal ridge extends partially across the top.

The trash container lid has a lock hole for receiving a lock. A lock hole bracket reinforces the lock hole. A handle and hinges, integral with the frame, extend through the lid.

A trash container system has a trash container and a lid for covering the trash container. The lid has a shape and size commensurate with the trash container opening. The lid has a plurality of ribs transversely extending across the lid.

The lid may have a tubular frame mounted within the lid. The lid may have a plurality of longitudinal ribs extending longitudinally along the lid.

The trash container may have a lip. The lid has a lower rise. When the lid is closed, the lower riser covers the lip for a substantial portion of the lip's diameter.

The trash container system includes a lid handle and hinges integral with the tubular frame and extending through the lid. The trash container system has a lock hole, the lock hole extending through the lid, the lock hole arranged to receive a lock for fastening the lid to the trash container.

These and other objects, advantages, and features of the invention will be readily understood and appreciated by reference to the detailed description of the preferred embodiment and the drawings.

DETAILED DESCRIPTION OF THE DRAWINGS

Figure 1:
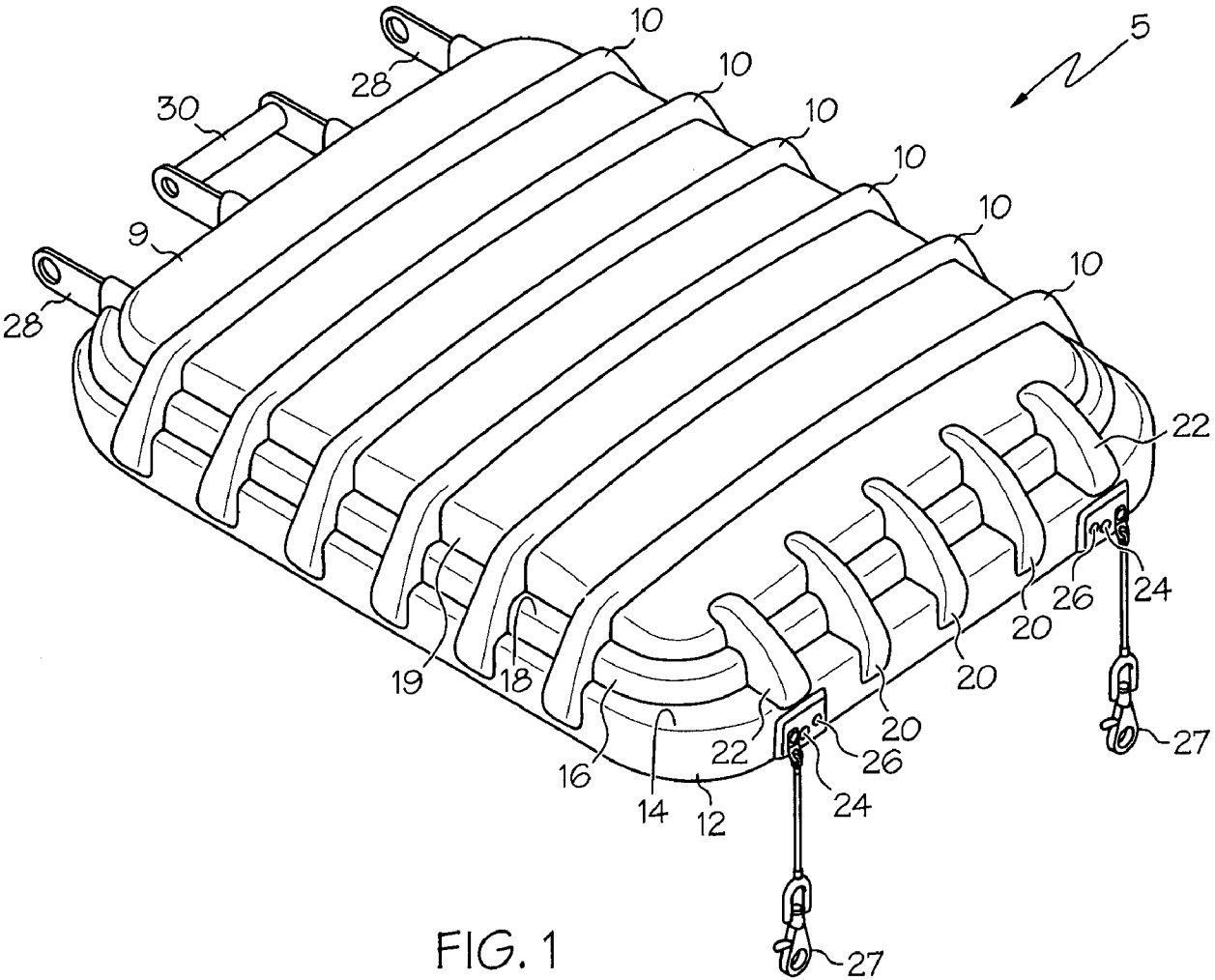
FIG. 1 shows an animal resistant trash container lid.

FIG. 1 shows an animal resistant trash container lid 5. Trash container lid 5 is generally rectangular. Transverse ridges 10 extend transversely across the lid. Trash container lid 5 has a series of steps from the bottom 7 to the top 9.

The steps are comprised of a series of risers and treads. Lower riser 12 extends from the bottom lip to lower tread 14. Middle riser 16 goes from lower tread 14 to middle tread 18. Upper riser 19 goes from middle tread 18 to top 9.

The lower riser 12 is of sufficient length so as to extend over the lip the trashcan. When the dimensions of the trashcan are carefully matched with the dimensions of the trash container lid 5, the gap between the interior of lower riser 12 and the trash container lip are minimized, creating a snug fit. The snug fit of lower riser 12 and the trash container lip creates an impediment to an animal, such as a bear, from reaching between the trash container lid 5 and the trash container lip so as to gain a strong hold of the trash container lid 5. This prevents an animal from forcibly removing the trash container lid 5 from the trash container.

Transverse ridges 10 extend from the lower riser 12 on one side of trash container lid 5 to the lower rise 12 on the opposite side of trash container lid 5. Major longitudinal ridges 20 extend from the anterior of lower riser 12 to the anterior of the top 9. Minor longitudinal ridges 22 extend from the anterior of lower tread 14 to the top 9. The combination of transverse ridges 10 and longitudinal ridges 20, 22 provide for extra strength and support of the lid. The extra strength and support of the ridges 10, 20, 22 resists tearing and/or rupturing of the lid when attacked by an animal.

Below each of minor longitudinal ridges 22 are lock holes 24. On either side of lock holes 24 are rivets 26. The lock holes 24 are for the attachment of locks 27 through lock holes 24 and through the trashcan lip. Locks 27, when attached through the lock holes 24 and the trashcan lip, provide a securing mechanism so that trash container lid 5 cannot be easily removed. Locks 27 should be of a kind requiring the use of an opposing thumb, thus making it difficult for any animal to open the lock.

On the posterior of trash container lid 5 are hinges 28. Hinges 28 extend through middle riser 16 and upper riser 20. Hinges 28 are preferably made of aluminum or some other strong and light material which cannot be easily broken by a large animal, such as a bear.

Similarly, handle 30 likewise extends through middle riser 16 and upper riser 20. Handle 30 is also made of aluminum or some other suitable materials.

Figure 2:
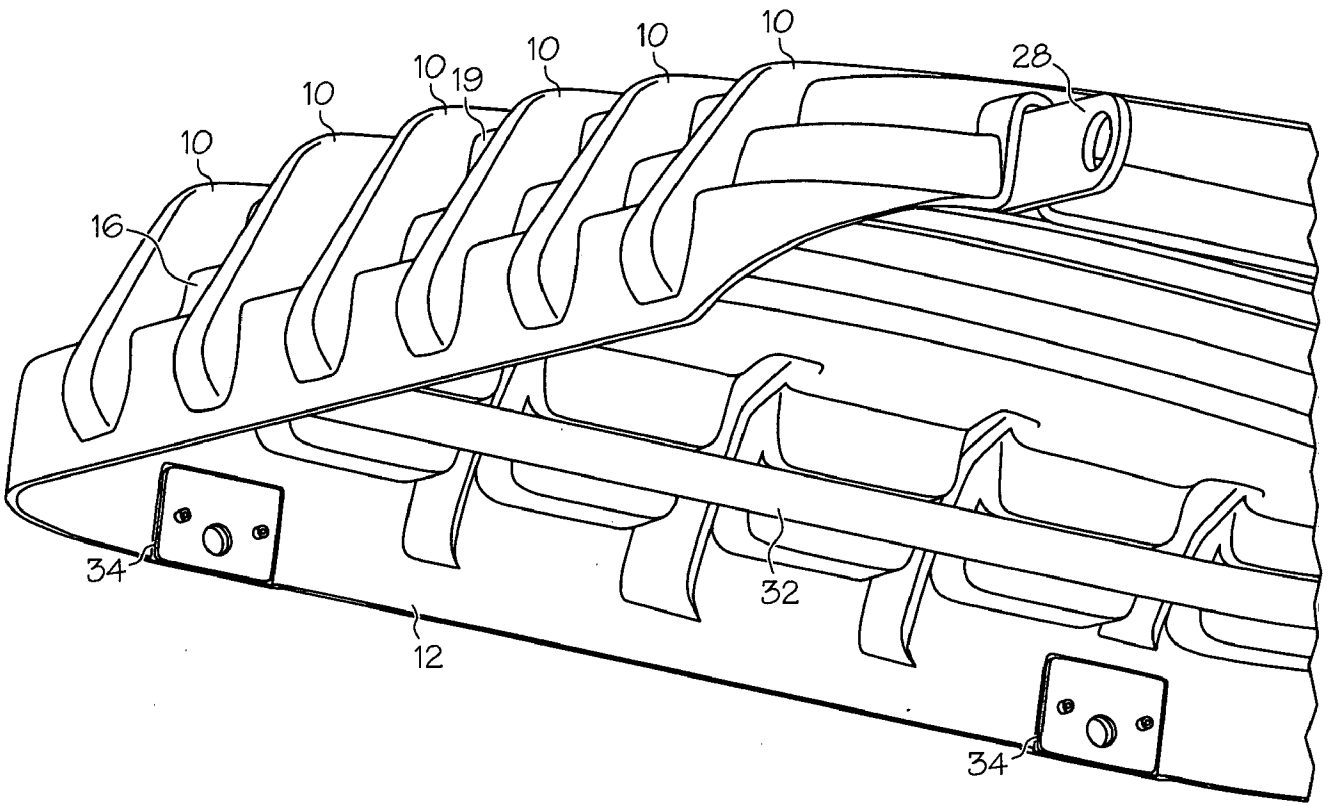
FIG. 2 is a partial view of the bottom of an animal resistant trash container lid.

FIG. 2 is a partial view of the bottom of trash container lid 5. The back of lower tread 14 and middle tread 18 are formed so as to form a notch for holding frame 32. The risers and treads form a wall, and the wall with the top forms an enclosure. Frame 32 is confined within the enclosure.

Figure 3:
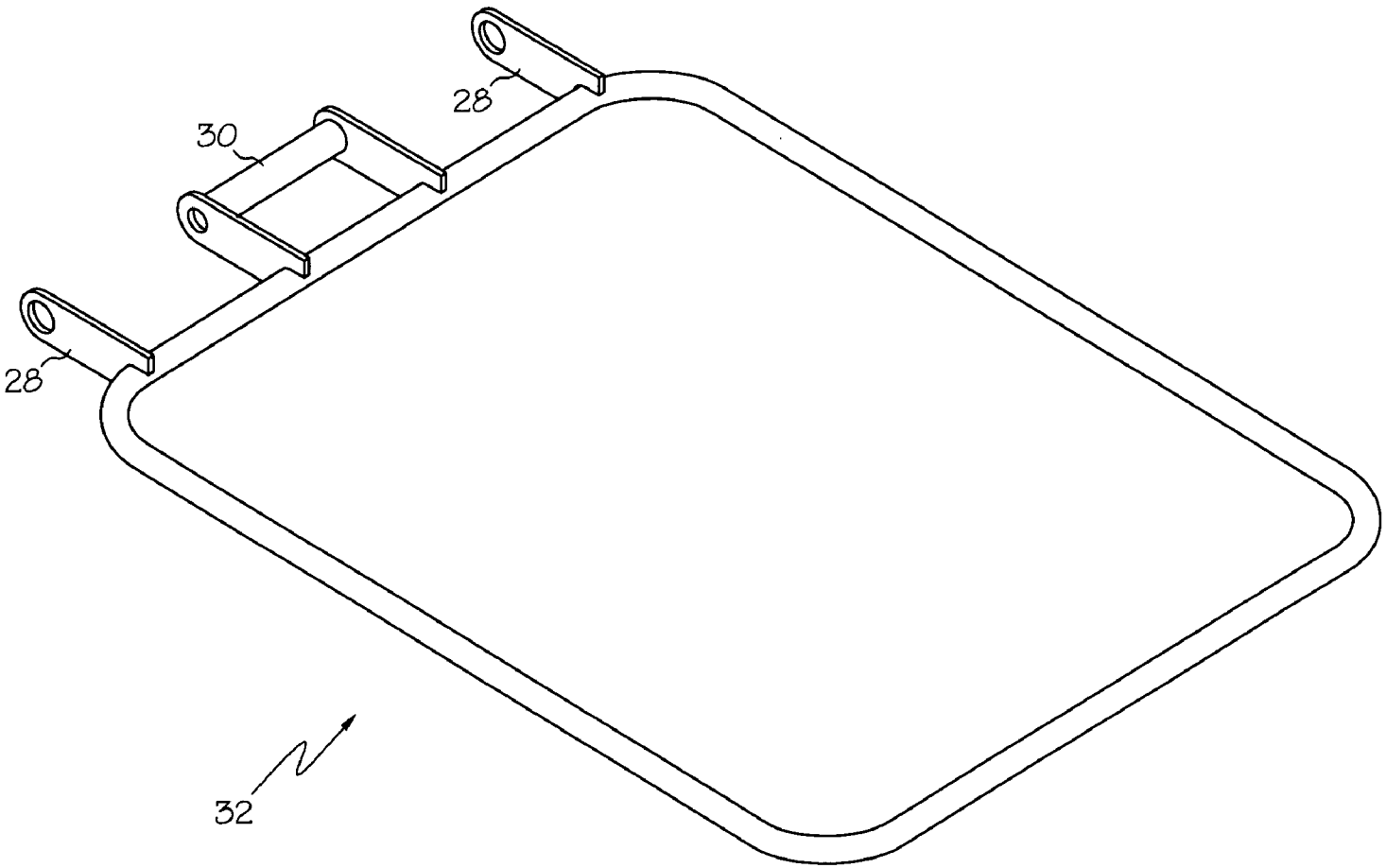
FIG. 3 shows a frame for supporting the animal resistant trash container lid.

FIG. 3 shows frame 32. Frame 32 is a tubular frame. Frame 32 is generally rectangular to match the shape of trash container lid 5. Hinges 28 and handle 30 extend from the back of frame 32. Frame 32 is made of aluminum or other material with sufficient strength and rigidity to withstand repeated stresses caused by the attack of animals on trash container lid 5. Reinforcing brackets 34 surround lock holes 24. Reinforcing brackets 34 are made of aluminum or other suitable material. The reinforcing brackets prohibit an animal, such as a bear, from tearing trash container lid 5 from a trash container by tearing the locks through the trash container lid 5.

Figure 4:
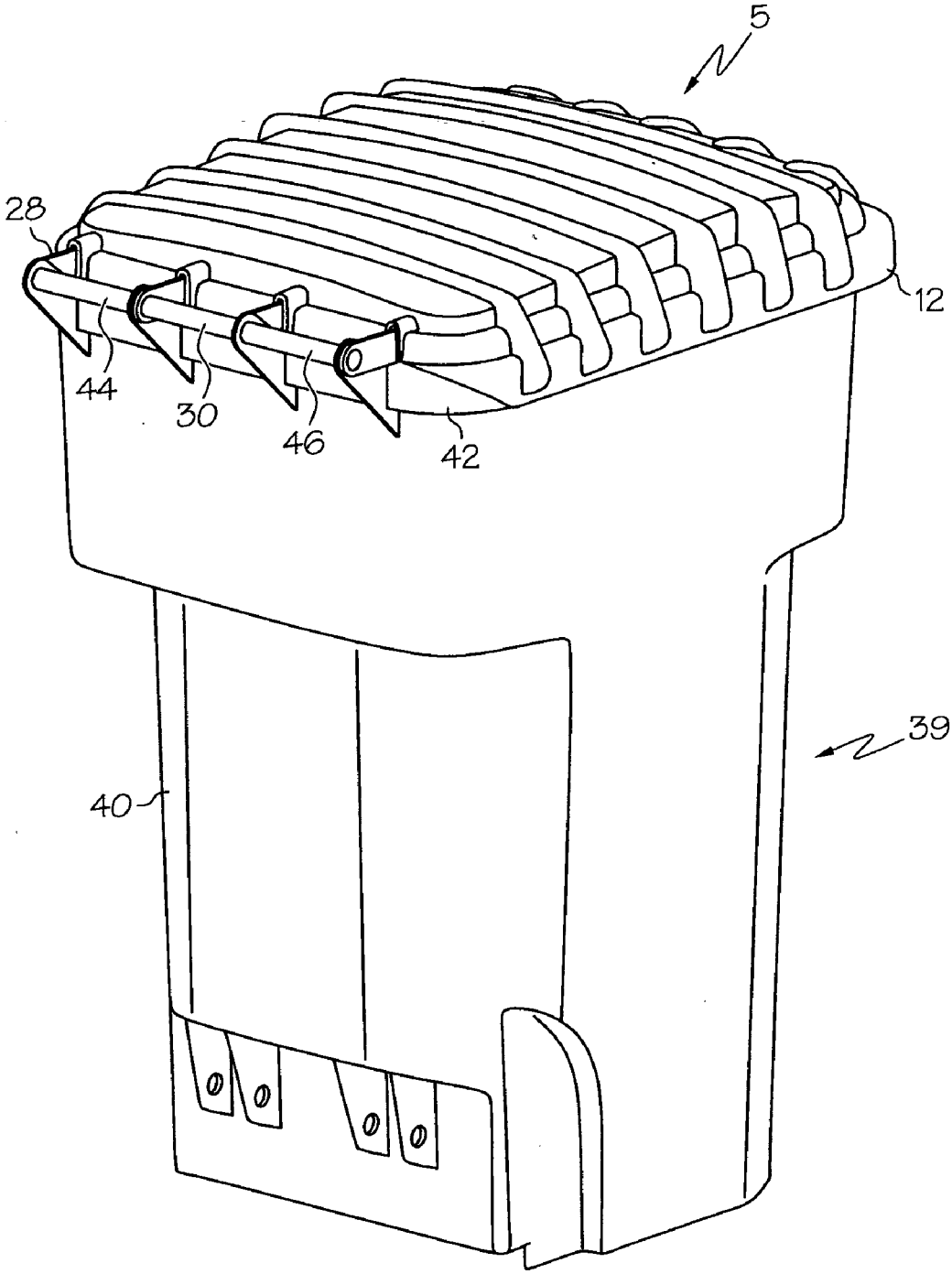
FIG. 4 shows an animal resistant trash container system.

FIG. 4 shows animal resistant trash container system 39. Trash container lid 5 sits on trash container 40. As shown, the lower riser of 12 of trash container lid 5 substantially covers lip 42 of trash container 40. The lip has a lip height, which extends vertically. The lip also has a lip circumference, which is the length of the lip around the trash container.

Trash container lid 5 fits snuggly with lip 42. The gap between trash container lid 5 and lip 42 should be minimized so that the fingers of an animal are prohibited from reaching between the trash container lid 5 and lip 42. It some applications, a gap of ¼ inch may be acceptable.

Handle 30 resides between trash container handles 44, 46. Hinges 28 are attached to the outer ends of handles 44, 46.

The above descriptions are those of preferred embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

What is claimed is:

1. A trash container lid for covering a trash container, the trash container having a lip, comprising:

a top, an outer wall;

a series of steps surrounding the top, the series of steps and the top forming an enclosure, the series of steps including a lower riser substantially covering the lip and the series of steps also including a middle riser;

a plurality of ridges extending across the top and down the series of steps;

a frame for supporting the trash container lid, the frame contained within the enclosure, the frame having a hinge for attachment to a container, the hinge extending through the outer wall;

a longitudinal ridge extending longitudinally on the top from the middle riser to the top;

a lock hole for receiving a lock;

lock hole bracket for reinforcing the lock hole; and a handle, the handle integral with the frame, the handle extending through the outer wall.

2. The trash container lid of claim 1 where the lower riser and the lip form a gap, and the lower riser is arranged so that the gap between the lower riser and the lip will have a gap of less than ¼ inch.

3. The trash container lid of claim 1 where the plurality of longitudinal ridges extends over at least a portion of the steps.

4. The trash container lid of claim 3 where the frame is attached to the steps.

* * * * *